US010027022B2

(12) United States Patent
Zhou et al.

(10) Patent No.: US 10,027,022 B2
(45) Date of Patent: Jul. 17, 2018

(54) ANTENNA FOR WIRELESS COMMUNICATION SYSTEM AND METHOD FOR FIXING ANTENNA OSCILLATOR TO REFLECTOR

(71) Applicant: Alcatel Lucent, Boulogne Billancourt (FR)

(72) Inventors: Chenguang Zhou, Shanghai (CN); Bo Zhao, Shanghai (CN); Beiming Xu, Shanghai (CN)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 15/039,535

(22) PCT Filed: Nov. 4, 2014

(86) PCT No.: PCT/CN2014/090230
§ 371 (c)(1),
(2) Date: May 26, 2016

(87) PCT Pub. No.: WO2015/078269
PCT Pub. Date: Jun. 4, 2015

(65) Prior Publication Data

US 2017/0025742 A1 Jan. 26, 2017

(30) Foreign Application Priority Data

Nov. 29, 2013 (CN) ..... 2013 1 0630121

(51) Int. Cl.
*H01Q 1/24* (2006.01)
*H01Q 21/26* (2006.01)
(Continued)

(52) U.S. Cl.
CPC ..... *H01Q 1/246* (2013.01); *H01Q 1/50* (2013.01); *H01Q 9/28* (2013.01); *H01Q 19/10* (2013.01);
(Continued)

(58) Field of Classification Search
CPC ..... H01Q 1/1207; H01Q 1/50; H01Q 1/246; H01Q 1/1221; H01Q 21/24; H01Q 21/26; H01Q 19/108
See application file for complete search history.

(56) References Cited

U.S. PATENT DOCUMENTS 7,358,922 B2 4/2008 Le et al.
2005/0001778 A1* 1/2005 Le ..... H01Q 1/246 343/810
(Continued)

FOREIGN PATENT DOCUMENTS

CN 2401997 Y 10/2000
CN 201011672 Y 1/2008
(Continued)

OTHER PUBLICATIONS

International Search Report for PCT/CN2014/090230 dated Feb. 9, 2015.

*Primary Examiner* — Robert Karacsony
(74) *Attorney, Agent, or Firm* — Fay Sharpe, LLP

(57) ABSTRACT

The present disclosure relates to an antenna for a wireless communication system. The antenna comprises a reflector having a front side for transmitting a signal and a back side opposite to the front side; an antenna oscillator disposed on the front side of the reflector; a phase shifter network disposed on the back side of the reflector; and an antenna oscillator fixing apparatus disposed on the front side of the reflector and configured to fix the antenna oscillator to the front side of the reflector. In addition, the present disclosure also relates to a method for fixing an antenna oscillator to a
(Continued)

reflector. With the antenna and the fixing method according to the present disclosure, it is possible to manufacture an antenna with an antenna oscillator that is easy to dismantle without damaging an existing phase shifter network, which will improve maintainability of the antenna according to the present disclosure dramatically and also reduce the cost of maintenance and repairs.

9 Claims, 5 Drawing Sheets

(51) Int. Cl.

| | |
|---|---|
| ***H01Q 19/10*** | (2006.01) |
| ***H01Q 1/50*** | (2006.01) |
| ***H01Q 9/28*** | (2006.01) |
| ***H01Q 21/24*** | (2006.01) |
| ***H01Q 21/06*** | (2006.01) |

(52) U.S. Cl.
CPC ..... *H01Q 19/108* (2013.01); *H01Q 21/06* (2013.01); *H01Q 21/24* (2013.01); *H01Q 21/26* (2013.01)

(56) References Cited

U.S. PATENT DOCUMENTS

| | | | | |
|---|---|---|---|---|
| 2005/0134517 | A1* | 6/2005 | Gottl ..... | H01Q 1/246 343/797 |
| 2008/0231528 | A1 | 9/2008 | Guixa Arderiu | |
| 2008/0309568 | A1 | 12/2008 | Deng et al. | |
| 2009/0058752 | A1 | 3/2009 | Lee et al. | |
| 2010/0182213 | A1* | 7/2010 | Obermaier ..... | H01Q 1/246 343/817 |

FOREIGN PATENT DOCUMENTS

| | | | |
|---|---|---|---|
| CN | 201207437 | Y | 3/2009 |
| CN | 201243085 | Y | 5/2009 |
| CN | 101707287 | A | 5/2010 |
| CN | 101714702 | A | 5/2010 |
| CN | 202178382 | U | 3/2012 |
| CN | 103633414 | A | 3/2014 |
| CN | 203617430 | U | 5/2014 |
| JP | 11-511614 | A | 10/1999 |
| JP | 2006-186880 | A | 7/2006 |
| JP | 2007-221441 | A | 8/2007 |
| JP | 2012-142220 | A | 7/2012 |
| JP | 2012-156993 | A | 8/2012 |

* cited by examiner

ANTENNA FOR WIRELESS COMMUNICATION SYSTEM AND METHOD FOR FIXING ANTENNA OSCILLATOR TO REFLECTOR

FIELD

The present disclosure relates to wireless communication technology, and more specifically relates to an antenna for a wireless communication system and a method for fixing an antenna oscillator to a reflector in a wireless communication system.

BACKGROUND

Antenna oscillator is a vital device in base station antennas. An antenna oscillator can be connected by soldering a cable and a Phase Shifter Network (PSN) at an end of the antenna oscillator for sending or receiving signals. Typically, an antenna oscillator is usually fixed to a reflector from a back side of the reflector by screws, and the cable is then soldered to a connection end of the antenna oscillator.

FIG. 1 and FIG. 2 show schematic diagrams of an antenna structure according to the prior art. FIG. 1 and FIG. 2 illustrate the antenna structure from a front side and a back side of a reflector, respectively. It can be seen from FIG. 1 that an antenna oscillator 120 is mounted on the front side of the reflector 110, whereas the fixation of the traditional antenna oscillator 120 is achieved on the back side of the reflector 110. This structure will be illustrated by means of FIG. 2. It can be seen from FIG. 2 that the antenna oscillator 120 is fixed on the back side of the reflector 110 by means of a screw 130. Moreover, since the antenna oscillator 120 is used for receiving and sending signals, it needs to be connected with cables 141 and 142 which transmit signals, respectively. In the traditional structure, the cables 141 and 142 are usually soldered to a connection end of the antenna oscillator 120 on the back side of the reflector 110, respectively. At last, a phase shifter network (not shown in the figures) is mounted on the cables 141 and 142 and the screw 130, namely, on the back side of the reflector 110.

However, such an antenna structure would generally require replacing the antenna oscillator due to some problems such as aging with usage time or pseudo soldering at the beginning when manufacturing. Then, the phase shifter network covered on the back side of the reflector must firstly be dismantled. However, the dismantling is generally irreversible. In other words, such dismantling would usually damage the mounted phase shifter network. This poses problems for maintenance of the antenna, increasing the difficulty of the maintenance on one hand and increasing the cost of the maintenance on the other hand.

SUMMARY

According to the above understanding of the background technology and the existing technical problems, a first aspect of the present disclosure provides an antenna for a wireless communication system, comprising:

a reflector having a front side for transmitting a signal and a back side opposite to the front side;

an antenna oscillator disposed on the front side of the reflector;

a phase shifter network disposed on the back side of the reflector; and an antenna oscillator fixing apparatus disposed on the front side of the reflector and configured to fix the antenna oscillator to the front side of the reflector.

The antenna oscillator and the antenna oscillator fixing apparatus according to the present disclosure are both mounted on one side of the reflector, namely, on the front side, so that the antenna with such a structure is easy to dismantle and a damaged part is easy to be replaced at a low cost or the required soldering quality is easy to be improved.

In an embodiment according to the present disclosure, the antenna oscillator comprises a coaxial cable soldering end disposed on the front side of the reflector and configured to connect with a coaxial cable for transferring signals to be transmitted and received by the antenna and required power. In this manner, the soldering point between the coaxial cable soldering end of the antenna oscillator and the coaxial cable for transferring signals to be transmitted and received by the antenna and required power is necessarily also located on the front side of the reflector, thereby further making an antenna with such a structure easy to dismantle and maintain.

In an embodiment according to the present disclosure, the coaxial cable soldering end extends in a direction parallel to the front side of the reflector. Such a structure is easy for manufacturing and facilitates a subsequent soldering process.

In an embodiment according to the present disclosure, the antenna further comprises a soldering apparatus disposed at a connection point on the reflector between the coaxial cable soldering end and the coaxial cable and configured to solder the coaxial cable soldering end to the coaxial cable. In this manner, it is more convenient in a manufacturing process of the antenna. That is, the antenna oscillator itself has a soldering apparatus, thereby facilitating both soldering and subsequent de-soldering.

In an embodiment according to the present disclosure, the soldering apparatus is an induction soldering apparatus. In this manner, the soldering quality of the soldering point between the coaxial cable soldering end of the antenna oscillator and the coaxial cable for transferring signals to be transmitted and received by the antenna and required power is further improved and the subsequent de-soldering process is easier.

In an embodiment according to the present disclosure, the induction soldering apparatus is further configured to decouple the coaxial cable soldering end from the coaxial cable. In this manner, further improvement is possible when some of the components are damaged in future or the soldering quality at the soldering point is not high, without causing irreversible destructive damages to the structure.

In an embodiment according to the present disclosure, the reflector comprises a hole configured to allow the coaxial cable for transferring signals to be transmitted and received by the antenna and required power to pass through the reflector.

In an embodiment according to the present disclosure, the front side of the antenna comprises a convex plate for fixing the antenna oscillator and there is a hole on the antenna oscillator for the fixing, wherein there is a screw connection between the hole and the convex plate.

Furthermore, a second aspect of the present disclosure provides a method for fixing an antenna oscillator to a reflector in a wireless communication system, comprising:

fixing the antenna oscillator on a front side of the reflector by using a fixing apparatus of the antenna oscillator; and connecting, on the front side of the reflector, a coaxial cable soldering end of the antenna oscillator with a coaxial cable extending from a back side of the reflector by using a soldering apparatus.

In an embodiment according to the present disclosure, the method further comprises:

decoupling the coaxial cable soldering end of the antenna oscillator from the coaxial cable extending from the back side of the reflector by using the soldering apparatus when the antenna oscillator needs to be replaced.

In an embodiment according to the present disclosure, the coaxial cable soldering end extends in a direction parallel to the front side of the reflector.

In an embodiment according to the present disclosure, the fixing apparatus of the antenna oscillator fixes the antenna oscillator on the front side of the reflector by using a screw connection.

With the antenna and the fixing method according to the present disclosure, it is possible to manufacture an antenna with an antenna oscillator that is easy to dismantle without damaging an existing phase shifter network, which will improve maintainability of the antenna according to the present disclosure dramatically and also reduce the cost of maintenance and repairs.

BRIEF DESCRIPTION OF THE DRAWINGS

Other features, objectives and advantages of the present disclosure will become more apparent by reading the following detailed description of the non-limiting embodiments with reference to the accompanying drawings.

In the drawings, the same or similar reference numbers represent the same or like apparatus (module) or step throughout different diagrams.

DETAILED DESCRIPTION OF EMBODIMENTS

Figure 1:
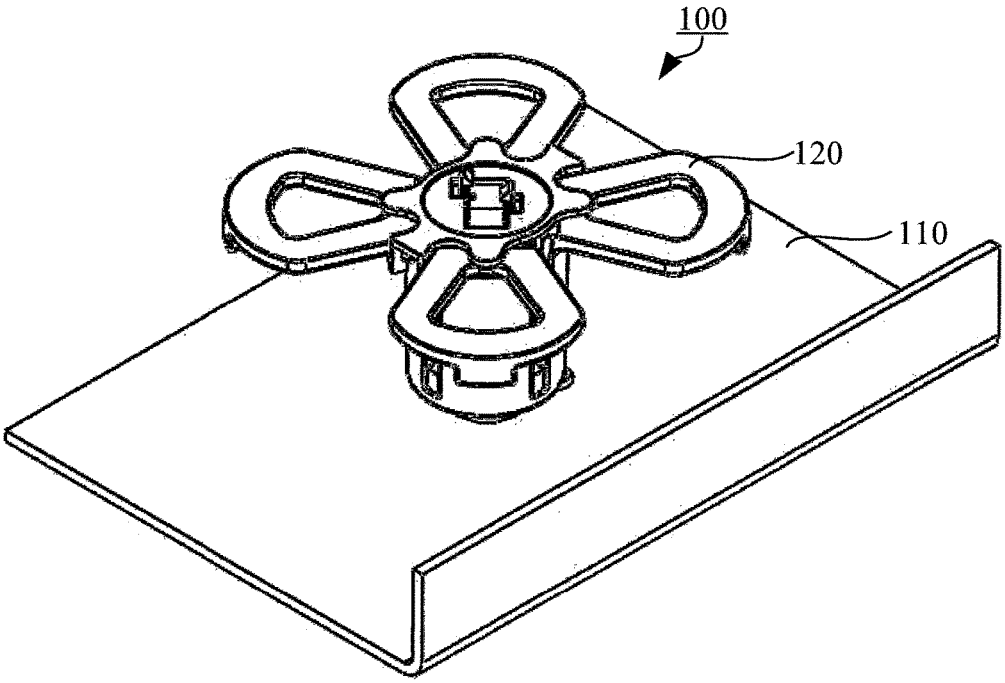
Fig. 1 Prior Art
FIG. 1 shows a schematic diagram 100 of a front side of an antenna structure according to the prior art.
Figure 2:
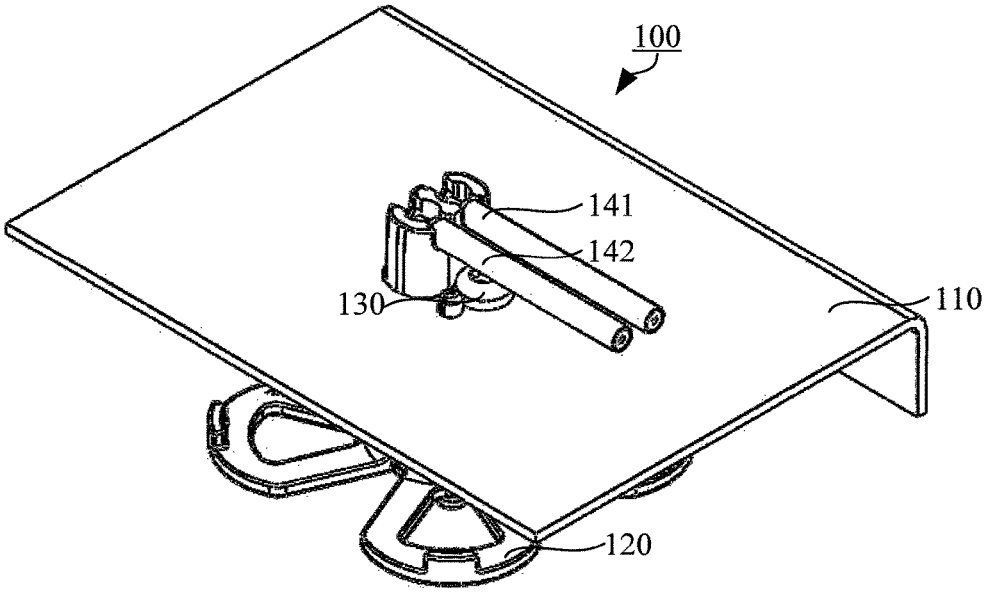
Fig. 2 Prior Art
FIG. 2 shows a schematic diagram 100 of a back side of the antenna structure according to the prior art.

FIG. 1 and FIG. 2 show a schematic diagram of a front side and a back side of an antenna structure according to the prior art, respectively. The antenna structure according to the prior art has been described in detail in the background section, and is not repeated here.

In the following, a structure diagram of an antenna according to the present disclosure and a flow chart of a method for manufacturing the antenna according to the present disclosure will be introduced emphatically.

Figure 3:
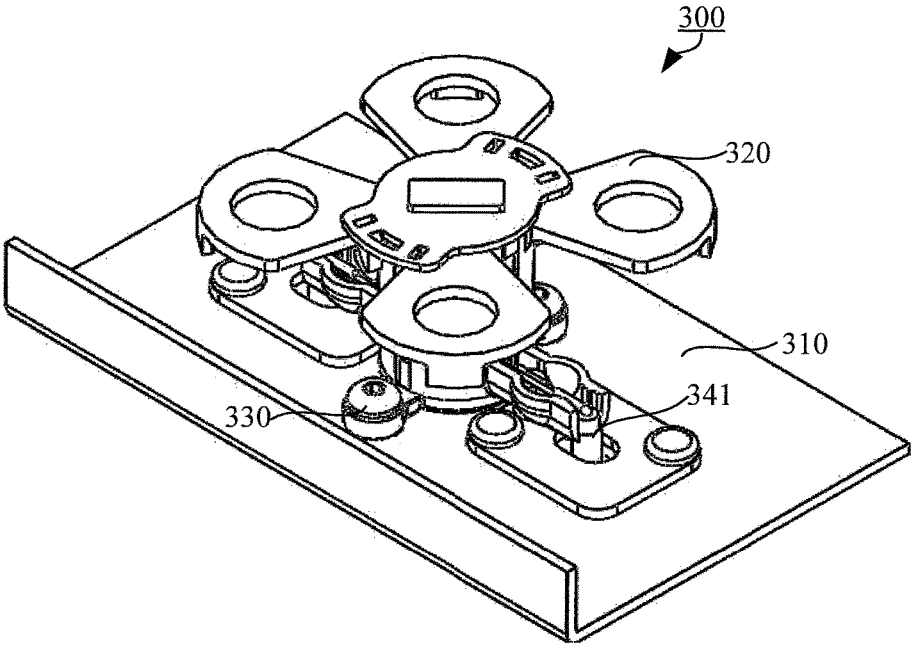
FIG. 3 shows a schematic diagram 300 of a front side of an antenna structure according to a first embodiment of the present disclosure.

FIG. 3 shows a schematic diagram 300 of a front side of an antenna structure according to a first embodiment of the present disclosure. It can be seen from FIG. 3 that the antenna 300 for a wireless communication system comprises the following components:

a reflector 310 having a front side for transmitting signals and a back side opposite to the front side;

an antenna oscillator 320 disposed on the front side of the reflector 310;

a phase shifter network (not shown in the drawings) disposed on the back side of the reflector 310; and an antenna oscillator fixing apparatus 330 disposed on the front side of the reflector 310 and configured to fix the antenna oscillator 320 on the front side of the reflector 310.

The antenna oscillator 320 and the antenna oscillator fixing apparatus 330 according to the present disclosure are both mounted on one side of the reflector 310, namely, on the front side, so that the antenna with such a structure is easy to dismantle and a damaged part is easy to be replaced at a low cost or the required soldering quality is easy to be improved.

In an embodiment according to the present disclosure, the antenna oscillator 320 also comprises a coaxial cable soldering end disposed on the front side of the reflector 310 and configured to connect with a coaxial cable for transferring signals to be transmitted and received by the antenna and required power. In this manner, the soldering point between the coaxial cable soldering end of the antenna oscillator 320 and the coaxial cable 341 for transferring signals to be transmitted and received by the antenna and required power is necessarily also located on the front side of the reflector, thereby further making an antenna with such a structure easy to dismantle and maintain.

In an embodiment according to the present disclosure, the coaxial cable soldering end extends in a direction parallel to the front side of the reflector 310. Such a structure is easy for manufacturing and facilitates a subsequent soldering process.

Figure 4:
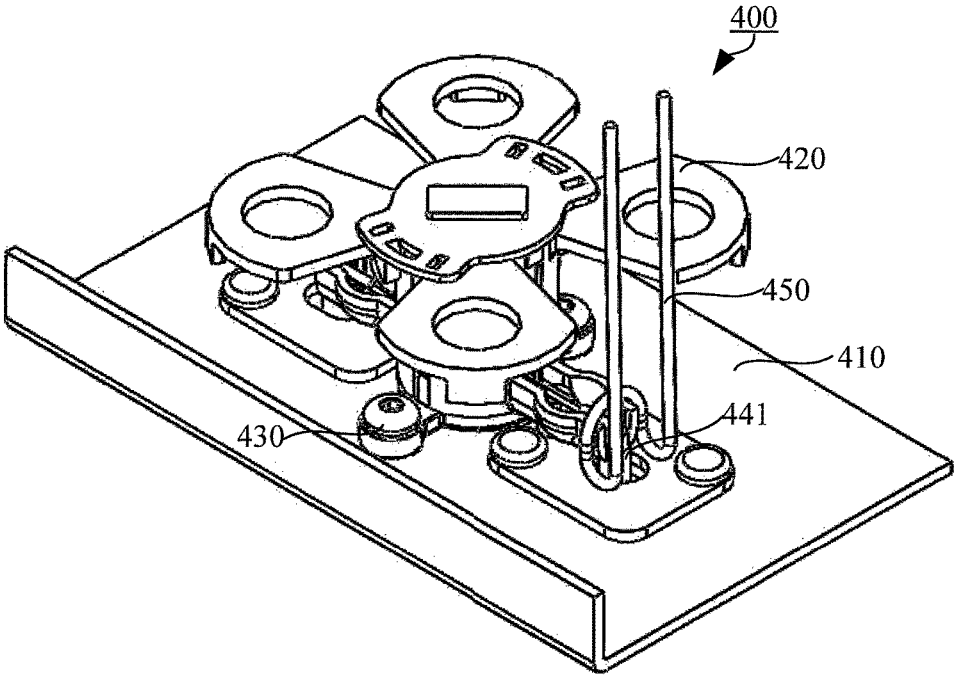
FIG. 4 shows a schematic diagram 400 of a front side of an antenna structure according to a second embodiment of the present disclosure.

In case that the coaxial cable soldering end and the coaxial cable 341 for transferring signals to be transmitted and received by the antenna and required power are both located on the front side of the reflector 310, and that there are problems like a confined spatial layout, although the traditional electric resistance welding can meet demands, another embodiment of the present disclosure will be illustrated by means of FIG. 4 for further improving the soldering quality of the soldering point between the coaxial cable soldering end of the antenna oscillator 320 and the coaxial cable 341 for transferring signals to be transmitted and received by the antenna and required power. FIG. 4 shows a schematic diagram 400 of a front side of an antenna structure according to a second embodiment of the present disclosure. It can be seen from FIG. 4 that the antenna 400 according to the present disclosure further comprises a soldering apparatus 450 disposed at the connection point between the coaxial cable soldering end on the reflector 310 and the coaxial cable 441 and configured to solder the coaxial cable soldering end to the coaxial cable 441. In this manner, it is more convenient in a manufacturing process of the antenna. That is, the antenna oscillator itself has a soldering apparatus, thereby facilitating both soldering and subsequent de-soldering.

In an embodiment according to the present disclosure, the soldering apparatus 450 is an induction soldering apparatus. In this manner, the soldering quality of the soldering point between the coaxial cable soldering end of the antenna oscillator 420 and the coaxial cable 441 for transferring signals to be transmitted and received by the antenna and required power is further improved and the subsequent de-soldering process is easier.

In an embodiment according to the present disclosure, the induction soldering apparatus 450 is further configured to decouple the coaxial cable soldering end from the coaxial cable 441. In this manner, further improvement is possible when some of the components are damaged in future or the soldering quality at the soldering point is not high, without causing irreversible destructive damages to the structure.

In an embodiment according to the present disclosure, the reflector 410 comprises a hole configured to allow the coaxial cable 441 for transferring signals to be transmitted and received by the antenna and required power to pass through the reflector 410.

In an embodiment according to the present disclosure, the front side of the antenna 400 comprises a convex plate for fixing the antenna oscillator 420 and there is a hole on the antenna oscillator 420 for the fixing, wherein there is a screw connection between the hole and the convex plate. Those skilled in the art should appreciate that the connection manner here includes but is not limited to the screw connection, and it may be other proper manner of connection, such as a rivet connection, etc.

Figure 5:
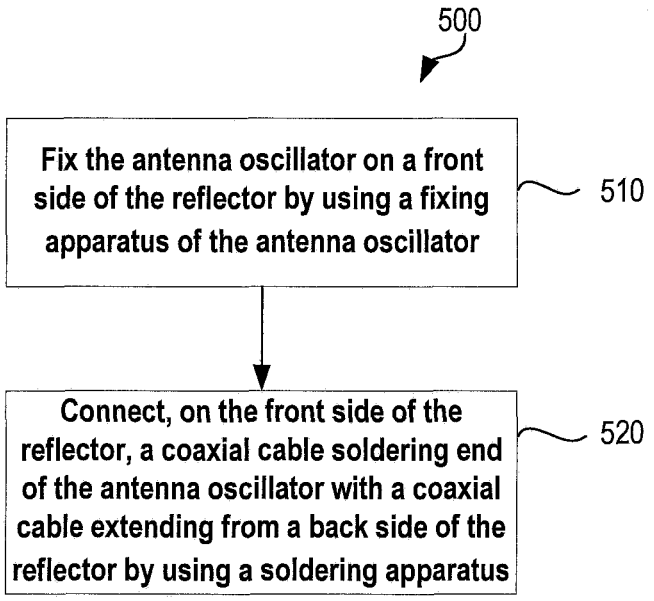
FIG. 5 shows a flow chart 500 of a method for fixing an antenna oscillator to a reflector in a wireless communication system according to the present disclosure.

In addition to the above-introduced antenna structure, the present disclosure also presents a method for fixing an antenna oscillator to a reflector in a wireless communication system. FIG. 5 shows a flow chart 500 of the method for fixing the antenna oscillator to the reflector in a wireless communication system according to the present disclosure. It can be seen from FIG. 5 that the method 500 comprises the following steps:

first, in step 510, fixing the antenna oscillator to a front side of the reflector by using a fixing apparatus of the antenna oscillator; and then, in the following step 520, connecting, on the front side of the reflector, a coaxial cable soldering end of the antenna oscillator with a coaxial cable extending from a back side of the reflector.

In an embodiment according to the present disclosure, the method 500 further comprises:

decoupling the coaxial cable soldering end of the antenna oscillator from the coaxial cable extending from the back side of the reflector by using the soldering apparatus when the antenna oscillator needs to be replaced (not shown in FIG. 5).

In an embodiment according to the present disclosure, the coaxial cable soldering end extends in a direction parallel to the front side of the reflector.

In an embodiment according to the present disclosure, the fixing apparatus of the antenna oscillator fixes the antenna oscillator on the front side of the reflector by using a screw connection.

With the antenna and the fixing method according to the present disclosure, it is possible to manufacture an antenna with an antenna oscillator that is easy to dismantle without damaging an existing phase shifter network, which will improve maintainability of the antenna according to the present disclosure dramatically and also reduce the cost of maintenance and repairs.

In the detailed description of the following preferred embodiments, references will be made to accompanying drawings which are a portion of the present disclosure. By way of example, the accompanying drawings show particular embodiments capable of implementing the present disclosure. The exemplary embodiments are not intended to exhaust all the embodiments according to the present disclosure. It may be appreciated that other embodiments may be employed and structural or logical modification may be made without departing from the scope of the present disclosure. Thus, the following detailed description is non-limiting and the scope of the present disclosure is defined by the appended claims.

For those skilled in the art, it is apparent that the present disclosure is not limited to the details of above exemplary embodiments. Meanwhile, without departing from the spirit or essential features of the present disclosure, the present disclosure can be implemented in other specific forms. Thus, the embodiments should, in any case, be taken as exemplary and non-limiting. In addition, apparently, the words "comprising" and "including" do not exclude other elements and steps, and the expression "a/an" does not exclude the plural form. The multiple elements set out in apparatus claims may also be implemented by one element. The expressions "first" and "second" or the like are used to indicate designations rather than any particular order.

What is claimed is:

1. An antenna for a wireless communication system, comprising:

a reflector having a front side for transmitting a signal and a back side opposite to the front side;

an antenna oscillator disposed on the front side of the reflector;

a phase shifter network disposed on the back side of the reflector; and an antenna oscillator fixing apparatus disposed on the front side of the reflector and configured to fix the antenna oscillator to the front side of the reflector;

wherein the antenna further comprises a soldering apparatus disposed at a connection point on the reflector between a coaxial cable soldering end and a coaxial cable and configured to solder the coaxial cable soldering end to the coaxial cable; and wherein the soldering apparatus is an induction soldering apparatus.

2. The antenna according to claim 1, wherein the coaxial cable soldering end is disposed on the front side of the reflector and is configured to connect with the coaxial cable for transferring signals to be transmitted and received by the antenna and required power.

3. The antenna according to claim 2, wherein the coaxial cable soldering end extends in a direction parallel to the front side of the reflector.

4. The antenna according to claim 1, wherein the induction soldering apparatus is further configured to decouple the coaxial cable soldering end from the coaxial cable.

5. The antenna according to claim 1, wherein the reflector comprises an hole configured to allow the coaxial cable for transferring signals to be transmitted and received by the antenna and required power to pass through the reflector.

6. The antenna according to claim 1, wherein the antenna oscillator is fixed to the antenna by a screw connection.

7. A method for fixing an antenna oscillator to a reflector in a wireless communication system, comprising:

fixing the antenna oscillator on a front side of the reflector by using a fixing apparatus of the antenna oscillator; and connecting, on the front side of the reflector, a coaxial cable soldering end of the antenna oscillator with a coaxial cable extending from a back side of the reflector by using a soldering apparatus; and decoupling the coaxial cable soldering end of the antenna oscillator from the coaxial cable extending from the back side of the reflector by using the soldering apparatus when the antenna oscillator needs to be replaced.

8. The method according to claim 7, wherein the coaxial cable soldering end extends in a direction parallel to the front side of the reflector.

9. The method according to claim 7, wherein the fixing apparatus of the antenna oscillator fixes the antenna oscillator on the front side of the reflector by using a screw connection.

* * * * *